US006189810B1

(12) United States Patent
Nerushai et al.

(10) Patent No.: US 6,189,810 B1
(45) Date of Patent: Feb. 20, 2001

(54) METHOD FOR AEROSOL SPRAYING LIQUID PERFUME PRODUCTS

(76) Inventors: Sergei Alexeevich Nerushai, Russia, 140000, Moskovskaya oblast, Ljubertsy, Komsomolsky prospekt, Moscow (RU); Nurakhmed Nurislamovich Latypov, 5Voikovsky proezd,d.10, kv.31, Moscow 125171 (RU)

( * ) Notice: Under 35 U.S.C. 154(b), the term of this patent shall be extended for 0 days.

(21) Appl. No.: 09/401,372

(22) Filed: Sep. 22, 1999

(30) Foreign Application Priority Data

Oct. 7, 1998 (RU) ..... 98118182

(51) Int. Cl.[7] ..... A62C 13/62

(52) U.S. Cl. ..... 239/306; 239/337; 239/433; 222/135; 222/402.1

(58) Field of Search ..... 239/306, 337, 239/418, 433, 543, 544; 222/137, 132, 162, 61, 402.1, 135

(56) References Cited

U.S. PATENT DOCUMENTS

| | | | | |
|---|---|---|---|---|
| 3,628,733 | * | 12/1971 | Kahn | 239/543 |
| 4,711,375 | * | 12/1987 | Mader et al. | 222/135 |
| 4,826,048 | * | 5/1989 | Skorka et al. | 239/306 |
| 4,902,281 | * | 2/1990 | Avoy | 222/137 |
| 5,005,736 | * | 4/1991 | Portas | 239/306 |
| 5,109,347 | * | 4/1992 | Quick, Jr. et al. | 222/135 |
| 5,449,117 | * | 9/1995 | Muderlak et al. | 239/70 |
| 5,746,354 | * | 5/1998 | Perkins | 222/135 |
| 5,772,074 | * | 6/1998 | Dial et al. | 222/646 |

FOREIGN PATENT DOCUMENTS

| | | |
|---|---|---|
| 2 563 981 | 11/1985 | (FR) . |
| 2 586 913 | 3/1987 | (FR) . |

* cited by examiner

*Primary Examiner*—Andres Kashnikow
*Assistant Examiner*—Dinh Q. Nguyen
(74) *Attorney, Agent, or Firm*—Burns, Doane, Swecker & Mathis, L.L.P.

(57) ABSTRACT

A method for aerosol spraying liquid perfume products consists of simultaneously spraying liquid perfume products and/or components of liquid perfume products, having different odors, in the form of aerosol streams into a region being treated. Aerosol spraying nozzles are placed proximate each other. The simultaneous spraying of at least two components of a liquid perfume product is carried out, and during the spraying the axes of the aerosol streams of the components are positioned at an angle to each other that ensures intersection of the aerosol streams. The spraying is carried out into at least three regions in which at least three different odors are obtained. Wherein, the third odor is formed in a region located between the first and second regions at the intersection of the aerosol streams of the two initial liquid perfume products. A microprocessor device is used to control the amount of the components of perfume liquids which are fed to micronozzles and from which different compositions of odors are formed, including odors which change in time.

20 Claims, 2 Drawing Sheets

METHOD FOR AEROSOL SPRAYING LIQUID PERFUME PRODUCTS

FIELD OF THE INVENTION

The present invention relates to the perfume industry, and more exactly, to a method for aersol spraying liquid perfume products, such as Eau-de-Colognes, perfumes, toilet water, deodorants, lotions, gels, etc.

BACKGROUND OF THE INVENTION

A method is known for aerosol spraying liquid perfume products, which consists of simultaneously spraying liquid perfume products and/or components of liquid perfume products having different properties or odors, into a region being treated, for example onto hair, in the form of aerosol streams intersecting in space, and one final product is obtained that has certain properties (see French patent No. 2586913, 1985).

When the method according to the patent is realized, only one final product with certain properties is obtained in a certain region of the space being treated. The method does not make it possible to obtain three different final products having different properties or different odors in one moment of time from two components with different properties or odors. Furthermore, the known solution does not make it possible to simultaneously spray a large number of components.

A device is known for aerosol application of perfume liquids, the device comprising two containers provided with spraying units comprising pumps with a spraying nozzle. The containers are designed to be filled with different perfume liquids having different odors (see the French utility model certificate No. 2563981, 1985).

A drawback of the known device is that it does not ensure the attainment of three or more perfume products having different odors in one moment of time from two initial perfume products, the three or more perfume products being distributed in a predetermined region in accordance with a user's wishes.

SUMMARY OF THE INVENTION

An object of the present invention is to create a method for aerosol spraying perfume products by combining at least two initial perfume odors to simultaneously create several, at least three, shades of odors distributed in a predetermined region in accordance with a user's wishes.

An object of the invention is also to create a device for aerosol spraying perfume products by combining at least two initial perfume odors to simultaneously create several, at least three, shades of odors distributed in a predetermined region in accordance with a user's wishes.

One more object of the invention is to develop a method for creating a perfume composition in an aerosol stream from a large number of initial components by means of dosed feeding to micronozzles.

And one more object of the invention is to develop a device to create a perfume composition in an aerosol stream from a large number of initial components by means of dosed feeding to micronozzles.

The stated object is achieved in that in a method for aerosol spraying liquid perfume products consisting of simultaneously spraying liquid perfume products and/or components of liquid perfume products, having different odors, in the form of aerosol streams into a region being treated, in accordance with the invention, nozzles for aerosol spraying are placed proximate one another, at least two components of the liquid perfume product are simultaneously sprayed, and during the spraying the axes of the aerosol streams of the components are arranged at an angle to each other that ensures the intersection of the aerosol streams, spraying is carried out into at least three regions in which at least three different odors are obtained, wherein the third odor is formed in a region located between the first and the second regions at the intersection of the aerosol streams of the two initial liquid perfume products.

It is advisable that the relationship between the three regions be changed by changing the distance from the nozzles to the areas on which the perfume products are applied.

It is useful that during the spraying, the quantity of aerosol mixtures fed to each of the regions is adjusted.

It is also useful that perfume products having different concentration of the components composing the perfume composition be used for aerosol spraying.

It is preferable that adjustment of the quantity of fed aerosol mixtures be carried out by changing the diameter of the outflow orifice of a nozzle.

It is advisable that different components selected from the group consisting of perfumes, toilet water, deodorants, Eau-de-Colognes, toilet scents, lotions, and also perfume liquids which lose their properties when stored for a lengthy period in one vessel, be used as the perfume liquids and/or components of the perfume liquids.

It is advantageous that the selection of the components of the perfume liquids be carried out in accordance with a map of odors, wherein different components are selected as components which have odors close to each other or odors that are radically different.

The stated object is also attained in a device for aerosol applying perfume liquids, comprising at least two containers with spraying units which contain a pump with a spraying nozzle, the containers designed to be filled with perfume liquids, in that in accordance with the invention, the containers are rigidly connected to each other and are filled with different perfume liquids or different components of perfume liquid, and the pumps are so arranged that the axes of their nozzles are at an angle to each other to ensure intersection of aerosol streams sprayed from the nozzles, wherein a means is provided for simultaneously pressing the pumps, the means rigidly connecting all of the pumps.

It is advisable that a cap combining the heads of the pumps be used as the means for simultaneously pressing the pumps.

It is useful that the containers be placed in one flask.

It is advantageous that the nozzles have identical or different diameter.

It is advisable that the nozzles be micronozzles with electronic control, and that the quantity of each component of the perfume liquid being sprayed be set by a program.

The stated object is also attained in that a method for creating a perfume composition in an aerosol stream includes the following steps: placing the components of perfume liquids in corresponding containers, simultaneously spraying liquid perfume products and/or components of liquid perfume products having different odors, into a region being treated in the form of aerosol streams, connecting the containers to components of perfume liquids by means of pipelines with dispensers with micronozzles mounted thereon, arranging outflow orifices of the micronozzles proximate each other, carrying out dosed supply of perfume liquids from corresponding containers in accordance with the required formulation to obtain a perfume composition in an aerosol stream.

It is useful that the dosed supply of perfume liquids be carried out by means of a microprocessor device with the use of a program and data.

It is advisable that a change of the data in time be carried out to obtain a sequence of different compositions by feeding new data to the micronozzles from the control microprocessor.

It is advantageous that data for obtaining a composition be received via telecommunications networks.

The stated object is also achieved in that a device for creating a perfume composition comprises at least two containers having spraying units, the containers designed to be filled with perfume liquids, said containers with perfume liquids connected through pipelines to dispensers, the dispensers being connected to micronozzles for injecting microstreams, wherein the micronozzles are positioned proximate to each other.

It is useful that the device comprise a microprocessor device with an according program and data for control of the micronozzle dispensers.

It is advantageous that the device be made autonomous and mobile like a mobile telephone.

It is advisable that a standard computer be used as the microprocessor device.

BRIEF DESCRIPTION OF THE DRAWINGS

Further, the invention will be explained by a description of a concrete embodiment with reference to accompanying drawings, wherein.

DETAILED DESCRIPTION OF THE PREFERRED EMBODIMENTS

Figure 1:
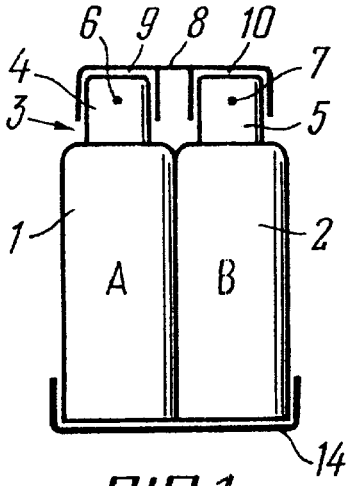
FIG. 1 shows a device comprising two containers, in accordance with the invention.

A device for aerosol application of perfume liquids comprises in the variant being described two containers 1 (FIG. 1) and 2. Each container 1 and 2 is filled with a perfume liquid A and B respectively, which have different properties, for example, odors, i.e. is filled with different perfumes or different perfume components. Each container 1 and 2 has a spraying unit 3 made in the form of a pump with heads 4 and 5, respectively. The heads 4 and 5 comprise spraying nozzles 6 and 7 respectively, which are mounted at an angle $\alpha$ to each other, i.e. their axes intersect at an angle $\alpha$ (not shown in FIG. 1). The device includes element 8 which ensures the simultaneous pressing of the heads and the release of liquid streams from spraying nozzles 6 and 7 at a predetermined angle relative to each other. The element 8 may be made in the form of a cap put on heads 4 and 5. The cap may be made with seats 9 and 10 for heads 4 and 5 of the pumps, the seats being positioned adjacent each other on one side of the cap.

Figure 2:
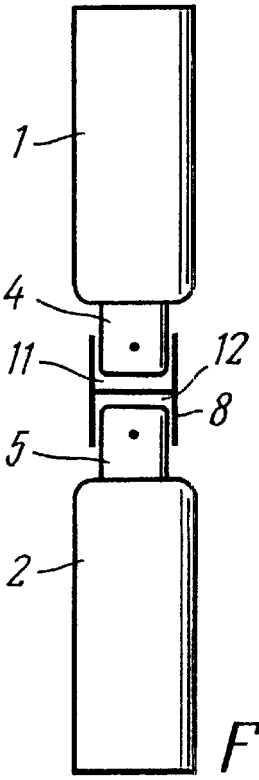
FIG. 2 shows a device with two containers, pumps of which are positioned on opposite sides, in accordance with the invention.

The cap may also be made with seats 11 and 12, positioned on opposite sides of the cap and opposite each other (FIG. 2).

In another embodiment, the device comprises three containers 1, 2, 13 (FIG. 3), the pump heads of which are combined by one element 8.

Figure 4:
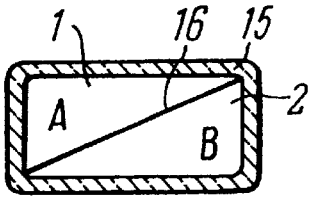
FIG. 4 shows a device made in the form of one flask with partitions, in accordance with the invention.

The containers 1 and 2 may be combined in one flask by means of a bottom plate 14 (FIG. 1) or be one flask 15 with a partition 16, separating the cavity of the flask 15 into two parts, which form the containers 1 and 2 filled with the aforesaid liquids A and B (FIG. 4).

The flask 15 may have a parallelogrammic cross section (not shown in FIG. 4). In that case the partition 16 is arranged along its diagonal. The partition 16 may be made with a mirror surface or transparent, for example, with a titanium layer ensuring its transparency from one side and mirror-like reflection from the other.

The spraying nozzles 6 and 7 may be made both with identical diameter of the outflow orifices and with different diameters. The aforesaid nozzles 6 and 7 may be made in the form of micronozzles similar to the printing heads of jet printers. In that case the amount of the injected perfume liquids or their components is controlled by the processor on the basis of data and a program.

Such a device may be used as a composer of odors which is controlled by the user via a corresponding interface of the computer and/or program. A plurality of different odors may be formed using a device like the head of a jet printer. The micronozzles may be cleaned by ultrasound, injected by means of piezo crystals or electromagnetic guns and locks as in jet printers. Finely-dispersed distribution ensures the attainment of the necessary combination in air or on a corresponding surface. If a user has such a device, data for obtaining a certain odor may be obtained over telecommunications networks. For example, a user may obtain data for controlling the device from Internet. If there is a database on odors, the computer program may generate new odors in accordance with a specified task.

Figure 5:
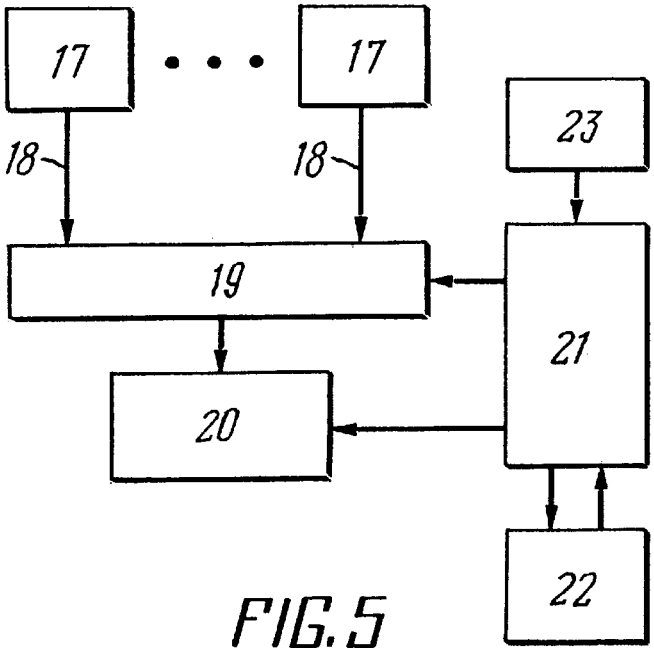
FIG. 5 shows a block diagram of a device for realizing the method of creating a perfume composition, in accordance with the invention.

FIG. 5 shows a diagram of a device for realizing a method for creating a perfume composition in accordance with the invention. Units 17 are containers with perfume liquids. Reference numeral 18 is a pipeline connected to dispensers 19 and injectors 20. Embodiments are possible wherein the dispenser and injector are realized in one device (not shown in FIG. 5). Microprocessor 21, connected to main memory 22, controls the parameters of the dispenser and the injector. The power supply for the microprocessor and other operating units is not shown in FIG. 5. The microprocessor may be connected to read-only memories or to a telecommunications network. Operation of the microprocessor relating to injection of perfume liquids may be initiated by a program coupled to a processor timer or from interface 23, controlled by a user. The user interface 23 may be an On/Off button, a keyboard, etc.

The method for aerosol spraying liquid perfume products is realized by means of the aforesaid device in the following manner.

Containers 1 and 2 (FIG. 1) are filled with different perfume liquids A and B, which have different odors. For example, these may be different components of perfumes or deodorants or different perfumes or deodorants, having different odors.

Components of perfumes consisting of constituents having close odors or of constituents having antagonistic odors may be used in order to expand the spectrum of the obtained odors. Furthermore, the method being patented makes it possible to use perfume components which lose their necessary properties in the case of lengthy maceration. I.e., it became possible to use such perfume components which, being in contact for a long period of time, either neutralize each other or release an unpleasant odor, but within a short period of time up to 24 hours provide the necessary original odor. Thus, using two different components, it is possible to obtain entirely new odors, wherein instead of two—three, two or one odor, differing one from the other. Selection of the aforesaid components in accordance with the coordinates of the map of perfumes, for example, a map in accordance with Table 1, and other maps compiled in accordance with other coordinates, makes it possible to more easily select the components which should fill containers 1 and 2.

Heads 4 and 5 enter the seats 9 and 10 or 11 and 12 and, thus, they are fixed in the required position with a predetermined angle to which nozzles 6 and 7 are directed relative to each other.

Figure 6:
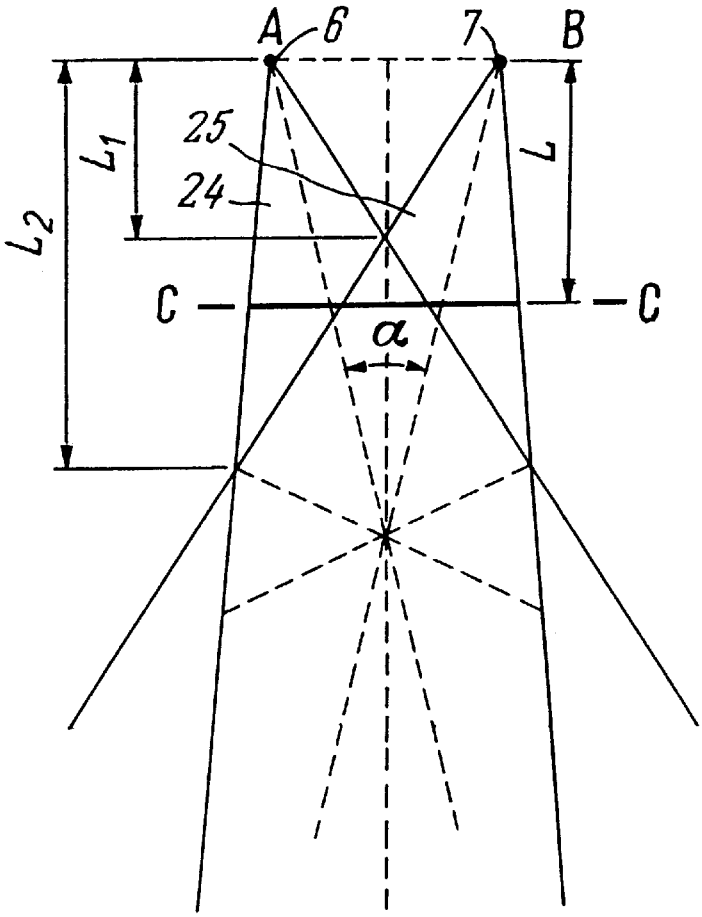
FIG. 6 shows the distribution of the components of perfume products in a plane N—N, spaced at a distance L from the base of aerosol streams, in accordance with the invention.
Figure 7:
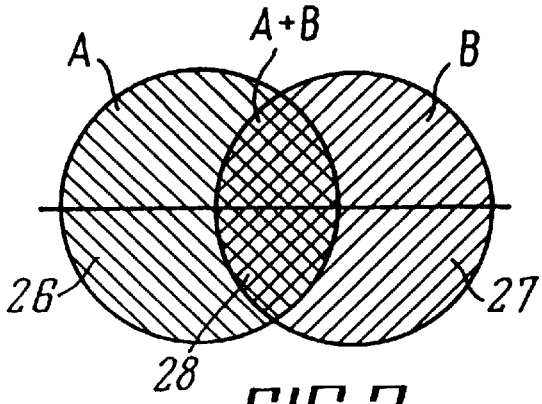
FIG. 7 shows a diagram of distribution of aerosol streams when spraying components of perfume products, in accordance with the invention.

The flask is so positioned that the spraying nozzles 6 and 7 are mounted at a predetermined distance L (FIG. 6) from the region to be treated, for example, from an arm, clothes, neck of the user. Pressure is applied to the cap 8 (FIG. 1) or to the bottom of containers 1 and 2. As a result of the pressure the contents of the containers 1 and 2 are sprayed from the spraying nozzles 6 and 7 in the form of aerosol streams 24 and 25 (FIG. 6). Since the axes of nozzles 6 and 7 are positioned at an angle $\alpha$ relative to one another, the aerosol streams 24 and 25 intersect, and in a certain region, for example, on the arm of a user, a new odor is formed at the areas of intersecting spots 26 (FIG. 7) and 27, which correspond to components A and B. Wherein, an odor is formed in region 28 which is a combination of the two components A and B.

A different combination of odors A and B may be obtained by changing the distance L. For example, at a distance from the nozzles to the surface on which the odors are applied which is less than L1, only two separate odors A and B are obtained. Beginning from a distance which is greater than L1, a combination of odors of components A+B also appears. The combination A+B increases relative to separate values of A and B right up until only a mixture A+B is obtained at a distance L2. At a distance greater than L2, once again there is a combination of A+B, A+b and B+a, where: a is a part of the stream A, which is carried by the stream B, and vice versa.

Thus, three spots, having different odors and properties, different consumer properties, are obtained on the applied to surface, for example, on an arm.

Perfumes or deodorants are selected in such a manner that when they mix a new odor is obtained which is different from the odor of the composite components. Components of perfumes or deodorants, which themselves have original odors, and in combination with each other provide a new original odor, may be used as the perfume liquids. The method for applying perfume liquids which is being patented provides a wide field of activity in order to obtain new original odors and their combination.

For example, one odor, consisting as a rule of many components, may be divided into two constituents. And one odor can be divided into two constituents by dozens of different methods, depending on the principle of dividing. For example, flower constituents may be put into one part, artificial odors into another. This separation may be done with accents, putting one and the same constituents in different amounts into different flasks. Or the most outstanding part of an odor, for example, tea rose, may be put into a separate constituent. In that case the note and the chord of the applied odor will be "taken" either together, or sequentially, depending on which odor will be closer to the user's nose, being in region 26 or 27.

The spaced application of odors onto the surface of clothes or a user's body during evaporation also provides a spatially spread odor. People near the user will feel different shades of the odors depending on the distance and the position of the user. The odor will seem to be spread in space according to its spectrum. Wherein, a user will sometimes note at the subconscious level an unusual change in the shades of the odors.

Figure 3:
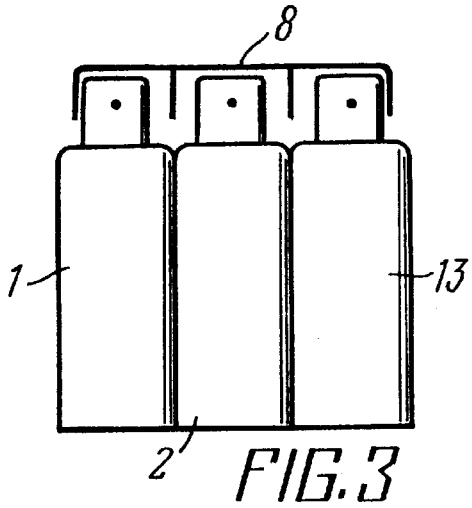
FIG. 3 shows a device comprising three containers, in accordance with the invention.

Another modification of the invention being patented is the possibility of using two or more containers with different perfume liquids (FIG. 3). This even more expands the possibility of making odors directly in space, obtaining several odors instead of one.

Furthermore, making the spraying nozzles in the form of micronozzles of jet devices with electronic control makes it possible to create a mixture of microdoses of components in air or an intricate pattern of a compound of perfume liquids on a surface. Many "pure" components, necessary to obtain perfumes, are applied to the controllable head of the micronozzles. By controlling the amount of sprayed components, it is possible to obtain as a result a concrete bouquet of odors. Such a realization of the micronozzles makes it possible to obtain "new" odors by Internet in the form of data for a program controlling the spraying, i.e. a new fashionable odor may be obtained from Internet. This new odor is synthesized at the user directly before using.

The aforesaid method may be used to create odors by means of a computer. The number of components being mixed may be determined by a person, by a computer or by a person and computer. Wherein, the new combinations are obtained rapidly and very efficiently, i.e. in minimum necessary doses for testing with the nose. The components whereby may be atomized in the air under the nose of the user or, for example, on a strip of material which by tradition is dipped into the prepared mixture to be tested. Favorable variants which are found will have a formulation in accordance with which it is possible to prepare a perfume liquid according to the traditional procedure, after which a final correction is made.

In the future "perfumes" will be a container with a set of pure odors or their most frequent combinations, especially those which require lengthy maceration.

Spraying components to obtain the necessary final odor, bouquet, accord will be carried out by a processor according to a program depending on the digital data describing that odor. Data on different combinations of odors, i.e. different perfumes, Eau-de-Colognes, etc., will be provided in a database in a read-only memory and on external carriers. By means of a menu a user may select the necessary perfumes in accordance with the initial components and their quantitative make-up and obtain, for example, a portion of the perfumes in the form of an aerosol stream. These data may be exchanged in the form of diskettes, flash memories, by contact and wireless methods, via telecommunications networks. These data may be edited, changed independently, and thus there is participation in the creative process of making new odors. One and the same cartridge may be used by different users to obtain combinations of components in accordance with their taste on the basis of different sets of data.

A so-called electronic generator of odors may be used for integration with a virtual helmet, wherein generation of odors may be carried out in accordance with a current condition in virtual space. For each entertainment or educational program, special cartridges may be prepared with the necessary set of odors. When there is an approach in virtual space to a flower, the odor of the corresponding flower may be fed into the helmet, when a virtual gun is fired—the smell of burnt powder. Perfume firms may acquaint potential users with their new compositions, exhibiting data on the Web page. On the basis of these data, which a user may jump to over the network, he may evaluate the proposed aromas. If a company does not want to open the secrets of the formulation of the composition, it may encode the data, then before controlling the dispenser at a user's device, the data should be decoded.

When a piezo element, placed adjacent the pump head, is used as a power supply, then by pressing the head it is possible to obtain an air stream and power supply for controlling the micronozzles from the obtained electrical charge from the piezo element.

Containers with components of perfume liquids may be made in the form of removable replaceable cartridges. Replaceable cartridges may comprise different sets of odors. These sets of odors may comprise pure odors and/or ready mixtures.

The device may be stationary or portable. It may be connected by means of a corresponding interface to a personal computer or be mounted in a cellular telephone. The device for obtaining microdoses of perfume compositions may comprise, in addition to a cartridge and micronozzles, different sets of components of microprocessor devices. For example, a microprocessor, a main memory, a flash memory, diskettes, wireless communication, a keyboard, a display. An aerosol mixture or stream will be obtained upon impact of the stream of liquid with air or an air flow.

It is possible to carry out the spraying of perfume compositions, which can be changed in time by feeding a flow of new data to micronozzles from a control microprocessor.

It is possible to carry out remote spraying of compositions onto a plurality of remote devices, transmitting data over telecommunications networks. A cartridge with micronozzles may be used as an attachment to a virtual helmet. Spraying compositions by a user will be carried out depending on his actions and the events in the virtual space in which he is immersed.

The described method may be used for treatment with odors. This will be especially useful when there is a necessity for sequential replacement of odors of dispensable medicinal preparations.

Known are perfume compositions, for example, Moving perfume, which change the shades of that odor after a sufficiently long period of time (hours). The claimed method makes it possible, if desired, to create a composition rapidly and in very small doses, actually for one breath. Accordingly, after a brief period, one injectable composition may be replaced with another. Wherein, the different compositions which are sequentially injected into the aerosol stream will have almost no possibility of mixing. Either the preceding composition will be absorbed by the user taking a breath, or it will be rapidly scattered in the surrounding space.

The proposed method and device make it possible to change the system of making note-accord perfume compositions. It becomes richer due to the possibility of creating whole odorous melodies and symphonies.

Spraying microstreams of perfume liquids into air and converting them into an aerosol stream or suspension depends on the speed at which the stream leaves the nozzle, the viscosity, volatility, surface tension of the liquids. The character of the aerosol stream depends on the direction of the microstreams, the presence or absence of an additional air stream.

TABLE 1

| Natural<br>A | B | cool<br>C | sport<br>D |
|---|---|---|---|
| Eau de Givenchy | O de Lancome | Kolnish Wasser 4711 | Lacoste |
| L'Eau d'Issey | New West | Eau de Guerlain | YSL |
| Cristalle | Quartz | Eau Sauvage | Armani pour Homme |
| V'E Iceberg | Diorella | Chevignon | Boucheron pour |
| Magnetic | Parfum d'Elle | Tropbee | Homme |
| Moods Donna | Action | Cool Water | Cerruti 1881 |
| Cabotine | Wrappings | Kenzo | Iseberg |
| | | Eternity | E.Aigner N 2 |
| Romeo | Vent Vert | Bath and Beauty Pure | Vetiver |
| Parfum d'Ete | Alliage | Miss Dior | Lauder |
| Calyx | Chanel N 19 | Woman 111 | Pasba |
| Red | Safari | Body Silk | Paco Rabanne |
| Kenzo | Trussardi | Cabochard | Globe |
| Amarige | Armani | Aramis | Drakkar Noir |
| Tiffany | Gucci N3 | Devin | Fabrenbeit |
| Rive Gauche | L'Arte | Moments | Nino Cerutti |
| Nina | Caleche | Feminite Du Bois | Ricci Club |
| Anais-Anais | Mme | Byzance | Antaeus |
| Diorissimo | Rochas | Aromatics Elixir | |
| Fidji | Valentino | Aramis 900 | |
| | Chanel N5 | | |
| Volupte | Joy | "Y" | Caractere |
| Paris | Sublime | Mitsuoko | Gentleman |
| Woman N 4 | Diva | Egoiste | Giorgio |

TABLE 1-continued

| Natural<br>A | B | cool<br>C | sport<br>D |
|---|---|---|---|
| White Linen | First | Femme | Bijan Men |
| Beautiful | Naj-Oleari | Gem | E/Aigner N 1 |
| Narcisse | Tres | Kouros | Moods Vomo |
| Spellbound | Jourdan | Fendi | Vendetta Vomo |
| Gio | Paloma Picasso | Knowing | Zino Davidoff |
| Betty Barclay | Solo Tu | Coco | |
| Chloe | Maroussia | Ysatis | |
| Carolina Herrera | Niki | Explosive | |
| | Bijan | Opium | |
| | Montana | Roma | |
| | Society | Cinnabar | |
| | Private Number | Nuitd'Ete | |
| | MCM1900 | | |
| | Chamade | | |
| C'est la Viel | Vanderbilt | Balahe | Jazz |
| Gabriela Sabatini | Dune | Molto Missoni | Samsara |
| Boucheron | Senso | Beverly Hills | Venezia |
| Guesa | Escada | Moschino | KL Homme |
| Ungaro | Krazy | Must de Cartier | Lagerfeld |
| Versus Donna | Krizia | Joop! Berlin | Kenzo pour Homme |
| Glorgio | Bogner Woman | Now! | Habit Rouge |
| Noa-Noa | Scherrer 2 | Obsession | Obsession |
| Laguna | Vendetta | Casmir | Santos |
| Colors de Benetton | Salvador Dali | Joop! Homme | Relax |
| | Joop | | |
| | Polson | | |
| | | Warm | |

What is claimed is:

1. A method for aerosol spraying liquid perfume products, comprising the following steps:

placing at least two nozzles for aerosol spraying proximate to one another, simultaneously spraying corresponding at least two components of a liquid perfume product from said at least two nozzles, and during the spraying placing axes of aerosol streams being created of said at least two components at an angle to each other that ensures the intersection of said aerosol streams, carrying out said spraying into at least three regions on which at least three different odors are created, forming said third odor in a region located between the first and the second regions at the intersection of said aerosol streams of said two initial liquid perfume products, as the perfume liquids and/or the components of perfume liquids used are different components, selected from the group consisting of perfumes, toilet water, deodorants, Eau-de-Colognes, toilet scents, lotions, and also perfume liquids which lose their properties when stored for a lengthy period in one vessel, and said components of said perfume liquids are selected in accordance with a map of odors, wherein different components are selected as components which have odors close to each other or odors that are radically different.

2. A method according to claim 1, wherein the relationship between the three regions is changed by changing the distance from said nozzles to an area on which said perfume products are applied.

3. A method according to claim 1, wherein during the spraying, the quantity of aerosol mixtures fed to each of the regions is adjusted.

4. A method according to claim 1, wherein adjustment of the quantity of aerosol mixtures being fed is carried out by changing the diameter of an outflow orifice of a nozzle.

5. A method according to claim 3, wherein said perfume products having a different concentration of the constituents composing the perfume composition are used for aerosol spraying.

6. A method for creating a perfume composition in an aerosol stream, comprising the following steps:

placing the components of perfume liquids in corresponding containers, simultaneously spraying liquid perfume products and/or components of liquid perfume products having different odors, in the form of aerosol streams, into a region being treated, connecting the containers to components of perfume liquids by means of pipelines with dispensers with micronozzles mounted thereon, arranging outflow orifices of the micronozzles proximate to each other, carrying out dosed supply of perfume liquids from corresponding containers in accordance with the required formulation to obtain a perfume composition in an aerosol stream, the data for obtaining a composition are obtained via telecommunication networks.

7. A method according to claim 6, wherein the dosed supply of perfume liquids is carried out by means of a microprocessor device with the use of a program and data.

8. A method according to claim 6, wherein a change of the data in time is carried out to obtain a sequence of different compositions by feeding new data to the micronozzles from the control microprocessor.

9. A method according to claim 8, wherein the micronozzles are arranged in the immediate vicinity of the user's nose.

10. A method according to claim 8, wherein microdoses of liquids are sprayed to form compositions of odors practically absorbed by a user in single inhalation, allowing to dynamically change odors without their intermixing.

11. A method according to claim 8, wherein spraying is carried out for a more complete immersion in a virtual reality.

12. A method according to claim 11, wherein formulation of a required mixture is carried out depending on the environment within a virtual space.

13. A method according to claim 6, wherein different sets of odor constituents are selected for various programs of a virtual reality.

14. A method according to claim 6, wherein a mixture is sprayed after a user made a correction of the data received via a network.

15. A device for creating a perfume composition comprises at least two containers having spraying units, the containers designed to be filled with perfume liquids, said containers with perfume liquids being connected through pipelines to dispensers, the dispensers being connected to micronozzles for injecting microstreams, wherein the micronozzles are positioned proximate to one another, and the device is made autonomous and mobile like a mobile telephone.

16. A device according to claim 15, which comprises a microprocessor device with an according program and data for control of the micronozzle dispensers.

17. A device according to claim 16, wherein a standard computer is used as the microprocessor device.

18. A device according to claim 17 intended for immersion in a virtual reality and arranged in the immediate vicinity of the user's nose.

19. A device according to claim 18, arranged as a unit connected to a virtual helmet.

20. A device according to claim 15 adapted to replace cartridges of odor sets or odor constituents.

* * * * *